United States Patent [19]

Der Kinderen, Deceased

[11] Patent Number: 5,001,397

[45] Date of Patent: Mar. 19, 1991

[54] HIGH-PRESSURE GAS DISCHARGE LAMP HAVING ELECTRODES WITH COIL LAYERS HAVING INTERLOCKING TURNS

[75] Inventor: Wilhelmus C. der Kinderen, deceased, late of Veldhoven, Netherlands, by Friedrich Jacobus De Haan, administrator

[73] Assignee: U.S. Philips Corporation, New York, N.Y.

[21] Appl. No.: 884,699

[22] Filed: Jul. 11, 1986

[30] Foreign Application Priority Data

Jul. 17, 1985 [NL] Netherlands ..... 8502035

[51] Int. Cl.[5] ..... H01J 61/06

[52] U.S. Cl. ..... 313/628; 313/631; 313/344; 313/575; 445/46; 445/51

[58] Field of Search ..... 313/628, 631, 633, 344, 313/575, 576; 445/46, 50, 51

[56] References Cited

U.S. PATENT DOCUMENTS

| | | | |
|---|---|---|---|
| 2,687,489 | 8/1954 | Anderson, Jr. et al. | 313/344 |
| 3,132,409 | 5/1964 | Freeman | 313/628 X |
| 3,170,031 | 2/1965 | Rokosz | 313/631 |
| 3,510,190 | 5/1970 | Taxil | 445/51 |
| 4,044,276 | 8/1977 | Keeffe et al. | 313/628 |
| 4,150,317 | 4/1979 | Laska et al. | 313/631 |
| 4,559,473 | 12/1985 | McVey | 313/631 X |

*Primary Examiner*—Donald J. Yusko
*Assistant Examiner*—Michael Horabik
*Attorney, Agent, or Firm*—Brian J. Wieghaus

[57] ABSTRACT

The high-pressure gas discharge lamp according to the invention has electrodes which comprise an electrode rod 24 and a helical winding 26 near its tip 25 projecting into the lamp vessel, both of mainly tungsten. The winding 26 has a first layer of turns 27 helically wound around the rod 24 and locally having a turn of high pitch 29. The winding 26 has around the first layer 27 an outer layer of turns 28, at least two of the outer layer turns interlock with the turn of the high pitch 29 of the first layer 27 at contact areas 30. The turns engage with clamping fit the rod 24 diametrically opposite thereto. As a result, the winding 26 is fixed on the rod 24. If the first layer 27 is integral with the outer layer 28, the winding 26 can be sufficiently fixed with one turn of outer layer 28 interlocking with the high pitched turn 29.

14 Claims, 2 Drawing Sheets

HIGH-PRESSURE GAS DISCHARGE LAMP HAVING ELECTRODES WITH COIL LAYERS HAVING INTERLOCKING TURNS

BACKGROUND OF THE INVENTION

The invention relates to a high-pressure gas discharge lamp comprising a translucent lamp vessel which is sealed in a vacuum-tight manner, which is filled with an ionizable gas and which has electrodes which project into the lamp vessel and are connected to current supply conductors extending through the wall of the lamp vessel to the exterior. Each electrode comprises a rod of mainly tungsten, which in the proximity of its tip projecting within the lamp vessel has a helical winding of wire of mainly tungsten, of which a first layer of turns is present around the rod and another layer of turns is arranged to surround the first layer. The first layer of turns locally having a turn of high pitch of at least the wire diameter of the first layer of turns plus the wire diameter of the other layer of turns, this winding being fixed on the rod and the wire of this winding having ends with end faces. Such a lamp is known from U.S. Pat. No. 3,170,081.

The purpose of the winding around the rod of an electrode is to obtain a satisfactory heat distribution over the electrode and to hold electron-emitting material.

It is mostly necessary to fix the winding on the rod, for example by deforming a turn in the hot state in order that it is clamped around the rod, or by welding the winding to the rod.

In the lamp according to the said U.S. Pat. No. 3,170,081, the first layer of turns is a body which is slipped with clearance around the rod and is fixed on it, while the other layer of turns is a separate body which is slipped around the first layer. In order to fix the second layer of turns, the first layer of turns has a projecting wire portion at its end remote from the tip of the rod of the electrode and the other layer of turns has at the corresponding end a wire portion which is bent towards the rod. This electrode construction renders the manufacture of the electrodes and hence of the lamp difficult.

SUMMARY OF THE INVENTION

The invention has for its object to provide a high-pressure gas discharge lamp of the kind mentioned, of which the electrodes have a simple construction that can be readily manufactured, the winding nevertheless being firmly fixed on the rod.

According to the invention, this object is achieved in a high-pressure gas discharge lamp of the kind described in the opening paragraph in that the outer layer of turns grips at least twice, while forming an equally large number of contact points, around a turn of high pitch of the first layer of turns and engages the rod of the electrode with clamping fit at least substantially diametrically opposite thereto.

In contrast with the electrodes according to the said U.S. Pat. No. 3,170,081, which are assembled from separately manufactured bodies, the electrodes of the lamp according to the invention can be obtained in that the winding is manufactured on the rod of the electrode itself as a winding mandrel. During the manufacture of the electrodes, an assembling step can thus be omitted, which is especially advantageous when the electrodes, the rods and the windings are small and hence vulnerable. Furthermore, a separate step for fixing the winding can be omitted. Nevertheless the winding of the electrode is firmly fixed.

The fixing of the winding on the rod of the electrode will now be explained. When a wire is wound around a mandrel (rod), the turns of this wire have a tendency to assume a larger diameter when the winding force is released. In the case of a circular mandrel, this larger turn diameter allows the wire to slip tangentially along the mandrel. This also applies to a second layer of turns which is disposed on a first layer of turns if the said second layer is wound in the same sense as the first layer. Also in this case, the "mandrel", i.e. the rod onto which the first layer was wound, together with this first layer is circular. If this second layer of turns is wound in the opposite sense, the "mandrel" is not perfectly round because the turns of this second layer each time have to jump over the turns of the first layer. The "out-of-roundness" of the mandrel is, however, very small. The deviation from the circular form only has the value of a fraction of the wire diameter, while the "mandrel" diameter is comparatively large, i.e. equal to the diameter of the rod onto which there is wound plus twice the wire diameter. Due to this small out-of-roundness, the wire also in this case can move tangentially, as a result of which the turns assume a larger diameter and the layers are detached.

The invention is based on the recognition of the fact that, when a wire is wound onto a rod with a "high" pitch, the assembly of rod and wire has a large out-of-roundness in the area of the turn of high pitch. The sheath of a cross-section of the rod and the wire is avoided. A turn of another layer of turns, which is wrapped as a sheath around said rod and said wire, in said area cannot substantially move tangentially and thus cannot be relieved. The winding around the rod is fixed to it if at least a part of the other layer of turns cannot be relieved due to the fact that this part is situated between two areas at which the other layer of turns is held because a tangential movement is not possible.

This recognition is also used in a lamp of the kind described in the opening paragraph, which is characterized according to the invention in that the first layer of turns is integral with the outer layer of turns and in that the outer layer of turns grips at least once, whilst forming an equally large number of contact areas, around a turn of high pitch of the first layer of turns and engages the rod of the electrode with clamping fit at least substantially diametrically opposite thereto.

Also in this embodiment, at least a part of the outer layer of turns is situated between two areas at which the outer layer of turns is held. The first area is that at which the first layer of turns passes into the other layer of turns. The second area is that at which the other layer of turns grips around a turn of high pitch in the first layer.

In a favourable embodiment, the first layer of turns locally has such a high pitch that two turns of the other layer of turns can be arranged beside each other around this turn of high pitch of the first layer of turns. For explanation of the term "pitch" it should be noted that, when the first layer of turns is made so as to have a pitch equal to the wire diameter of this layer, adjacent turns engage each other laterally.

The electrode and hence the high-pressure gas discharge lamp can be manufactured even more readily if the winding of the rod of the electrode has a wire end with a rupture surface. Such a rupture surface is obtained in that, after the operation of helically winding has been effected, the remaining wire portion not wound helically is severed from the winding by tearing it off. The wire then breaks at the area at which it loses its contact with the electrode.

Rupture surfaces have a characteristic appearance, as a result of which they can be readily recognized by those skilled in the art. They have a rough surface which is dull due to the roughness. Furthermore, they are devoid of tracks, such as grooves or a burr. which are left by tools, for example clipping-, pinching-, cutting- or grinding-tools, in or at a separation surface.

When torn off, a force is exerted on the wire which produces therein a plastic deformation. The diameter of the wire is reduced, or necked-down near the rupture surface. The extent of the necking-down is greater when before winding the wire is headed to an elevated temperature. for example between 800° and 850° C., in order to stretch the wire. Another consequence of the plastic deformation is that the wire follows the surface of the "mandrel" around which it is wound at least substantially as far as the rupture surface, and that the wire does not or substantially not project beyond the sheath of the winding.

When the winding around the rod of the electrode is formed, the beginning part of the wire is held in a clamp. When the winding is finished, this beginning part can be severed in a corresponding manner by tearing it off the winding.

An electrode with a winding having a rupture surface at a wire end thereof has the advantage of a simple manufacture without tools being needed for clipping, pinching, grinding or cutting, in which operations burrs are nearly always formed. Moreover, with such tools, the electrode cannot be approached very closely, specially when the winding must not be damaged, so that in the case of pinching, clipping, grinding or cutting the ends of the winding project beyond the sheath of the winding. This may be disadvantageous because the electrode then cannot be slipped inside through a narrow opening in the discharge vessel. If a protruding end is near the tip of the electrode rod, there is a risk that the discharge arc terminates on it reducing lamp performance.

The lamp according to the invention may be a high-pressure sodium lamp provided with a ceramic lamp vessel of, for example, (polycrystalline) aluminia or (monocrystalline) sapphire, or a high-pressure mercury discharge lamp which may contain metal halide and has a lamp vessel of ceramic material or quartz glass.

Embodiments of the lamp according to the invention are shown in the drawing. In the drawing:

DESCRIPTION OF THE PREFERRED EMBODIMENTS

Figure 1:
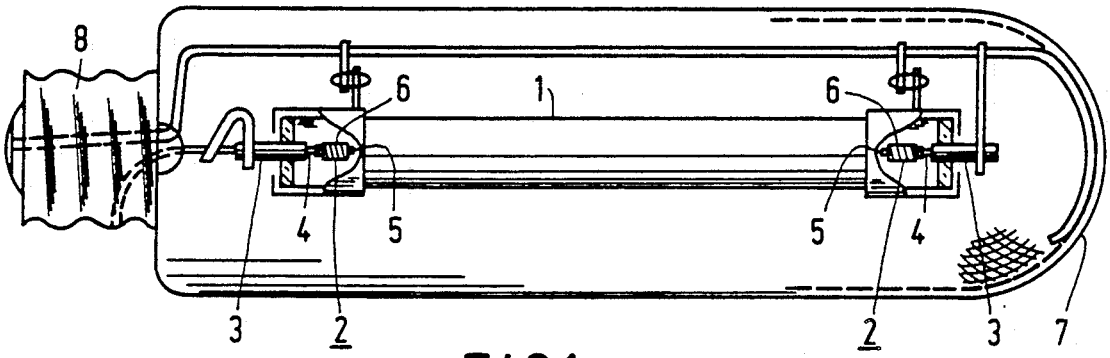
FIG. 1 shows in a side view a high-pressure sodium discharge lamp with a pair of electrodes.

The high-pressure sodium discharge lamp shown in FIG. 1 has a translucent lamp vessel 1 of mainly alumina, which is sealed in a vacuum-tight manner and has an ionizable filling of sodium, mercury and xenon. Electrodes 2 project into the lamp vessel 1 and are connected to current supply conductors 3, which extend to the exterior through the wall of the lamp vessel. The electrodes 2 each have a rod 4 of mainly tungsten, which has near its tip 5 projecting within the lamp vessel 1 a helical winding 6 of wire of mainly tungsten. A first layer of turns locally having a turn of high pitch of at least the wire diameter of the first layer of turns plus the wire diameter of another layer of turns of the helical winding 6, is present around the rod 4, while another layer of turns is arranged to surround the first layer of turns. The winding 6 is fixed on the red 4. The electrodes 2 are described more fully with reference to FIGS. 3 to 6. while alternatives are described with reference to FIG. 7. The lamp vessel 1 is arranged in an outer bulb which is sealed in a vacuum-tight manner and has a lamp cap 8.

Figure 2:
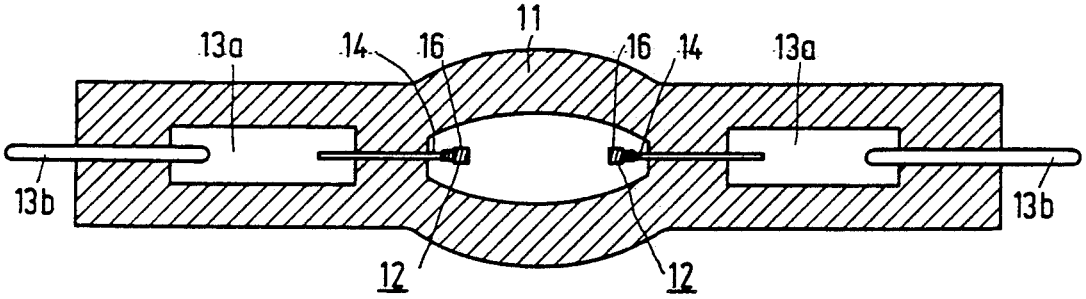
FIG. 2 shows in longitudinal sectional view a high-pressure mercury discharge lamp with electrodes.

The high-pressure mercury discharge lamp shown in FIG. 2 has a quartz glass lamp vessel 11 which is sealed in a vacuum-tight manner and has an ionizable filling of argon, mercury, and sodium, scandium and thallium iodide. Electrodes 12, which are connected to current supply conductors 13*a*, 13*b* which project beyond the lamp vessel 11. Electrodes 12 project into the lamp vessel 11. They have an electrode rod 14 of mainly tungsten, which has at its tip projecting inside the lamp vessel 11 a helical winding 16 of wire of mainly tungsten. Of the helical winding 16, a first layer of turns locally having a turn of high pitch of at least the diameter of the first layer of turns plus the diameter of another layer of turns is present around the rod 14, while another layer of turns is arranged to surround the first layer of turns. The winding 16 is fixed on the rod 14. The electrodes 12 are described more fully with reference through FIGS. 3 to 6, while alternatives are described with reference to FIG. 7.

Figure 3:
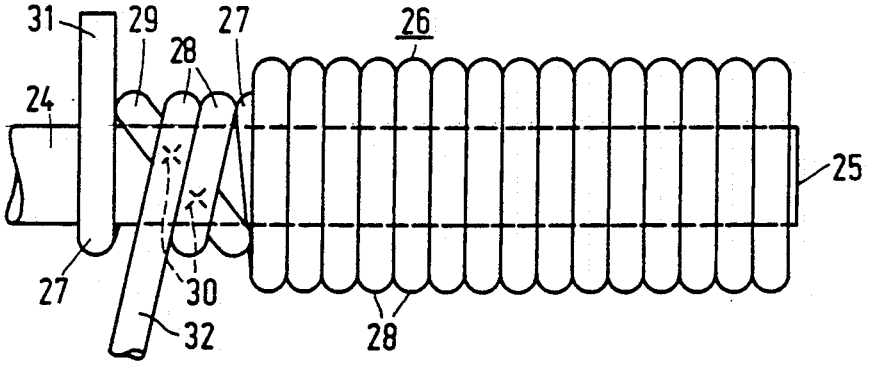
FIG. 3 shows in side view an electrode during its manufacture.
Figure 4:
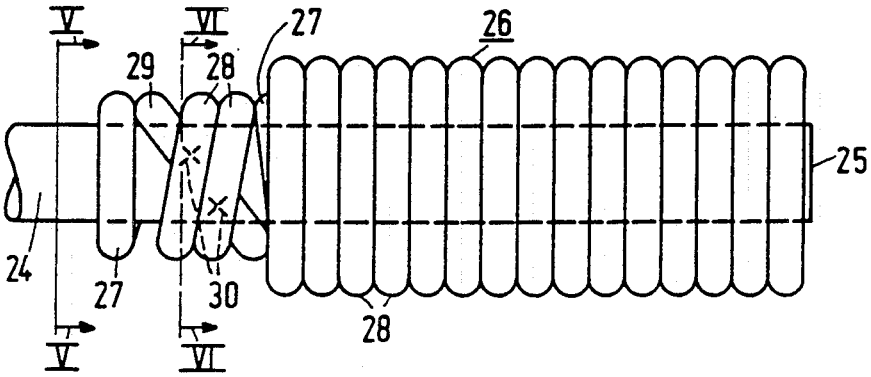
FIG. 4 shows in side view the electrode of FIG. 3 in the finished state.
Figure 5:
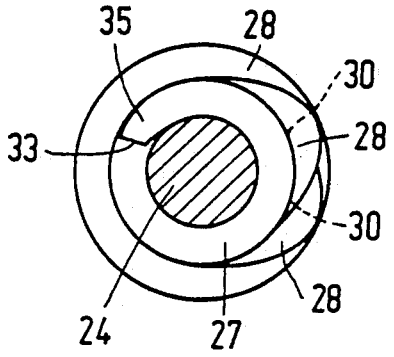
FIGS. 5 and 6 show diagrammatic sectional views taken on V—V and VI—VI, respectively, in FIG. 4.
Figure 6:
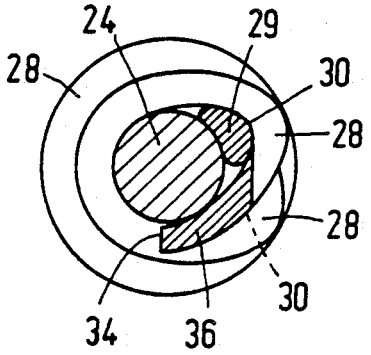

In FIGS. 3 and 4, the electrode rod 24 of mainly tungsten has at its tip 25 projecting inside the lamp vessel a helical winding 26 of mainly tungsten. The electrode rod 24 is directly surrounded by a first layer of turns 27, whose last turn passes at the tip 25 of the rod 24 into the first turn of another layer of turns 28, which is arranged to surround the first layer of turns 27. As a result, the first layer of turns 27 is integral with the other layer of turns 28.

The first layer of turns 27 locally has a turn 29 of high pitch of at least twice the wire diameter. In the drawing, the pitch of the turn 29 is about four times the wire diameter. The outer layer of turns grips at least once, and in the embodiment shown twice, around the turn 29 of the high pitch, while forming an equally large number of contact areas, which are indicated in the drawing by dotted crosses 30. The outer layer of turns 28 engages with clamping fit the rod 24 substantially diametrically opposite to the contact areas.

During the manufacture of the winding 26, the beginning part 31 of the winding wire is held in a clamp. After the winding 26 has been finished, the beginning part 31 is severed, in this embodiment by applying a tension force in the wire so that the rupture or breaking stress is exceeded. The remaining non-wound wire portion 32 is severed in the same manner.

Due to the fact that the first layer of turns 27 and the outer layer of turns 28 pass into each other near the tip 25 and due to the fact that the outer layer of turns grips around the turn 29 of high pitch, the winding cannot be relieved and it is fixed on the rod 24. It should be noted that in the embodiment shown in the winding 26 would also be fixed on the rod 24 if the first layer of turns 27 should not be integral with the outer layer of turns 28. Due to the fact that the outer layer of turns 28 grips twice around the turn 29 of high pitch of the first layer 27, a fixing exists already between the contact areas 30. In the diagrammatic sectional views of FIGS. 5 and 6, the great extent of out-of-roundness of those turns of the outer layer 28 gripping around the turn 29 of high pitch is clearly visible. the rupture surface 33 and the reduction of the wire diameter of the wire end 35 of the winding 26 near this surface 33, which rupture surface 33 has formed when tearing off the beginning part 31 of the winding wire (FIG. 3), are visible in FIG. 5. Likewise, the rupture surface 34 of the end 36, which as formed when severing the remaining non-wound wire portion 32, is visible in FIG. 6.

Figure 7:
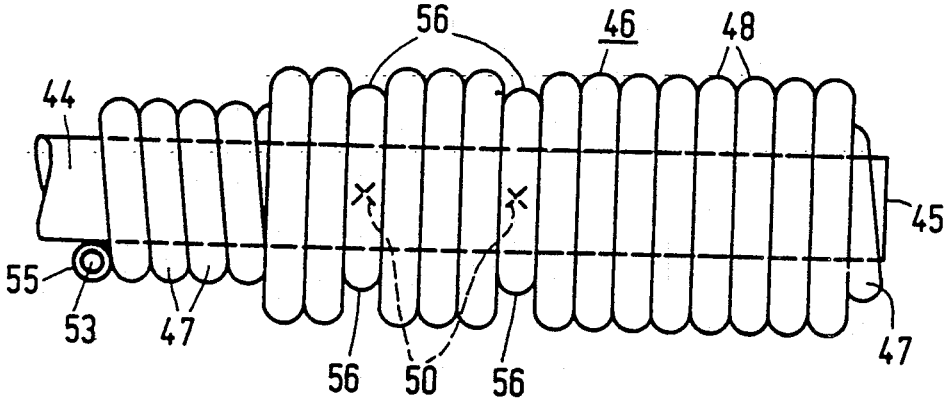
FIG. 7 shows in side elevation another embodiment of the electrode.

In FIG. 7, the winding 46 of mainly tungsten around the rod 44 of mainly tungsten has near its tip 45 a first layer of turns 47 and a separate outer layer of turns 48. A wire end 55 of the first layer of turns 47 is visible with a rupture surface 53. The first layer of turns 47 has two turns of high pitch, the pitch being equal to the wire diameter of the first layer of turns 47 plus the wire diameter of the outer layer of turns 48. These turns are not directly visible in the Figure; however, they nevertheless become manifest therein. The contact areas which have formed where the turns of the outer layer 48 grip around the turns of high pitch, are indicated by dotted crosses 50. The turns 56 of the outer layer of turns 48 engage with clamping fit the rod 44 substantially diametrically opposite thereto. Since two turns of the outer layer interlock with a respective high-pitched turn and the two outer layer turns engage the electrode rod 45 with a clamping fit, the electrode coil is firmly secured to the electrode rod.

In a 30 W metal halide lamp of the kind shown in FIG. 2, electrodes of the kind shown in FIG. 4 were used. The rod had a diameter of 140μm and wire having a diameter of 50 μm was wound around this rod over a length of about 1 mm. The wire and the rod consisted of tungsten containing 1.5 % by weight of $ThO_2$. The winding was manufactured while the wire was subjected to a tensile force of 0.6 N. Before winding, the wire was heated at 800° to 850° C. The beginning part of the wire and the remaining non-wound part were severed from the winding by the breaking stress was exceeded force of 5 N. A reduction in diameter or necking down was then obtained near the rupture surfaces.

It has been found that the electrode winding is firmly fixed to the electrode rod when the wire is wound around the electrode rod according to the invention. While it is normally at least a force of 7 N is required to push a winding off a rod, in lamps according to the invention the winding could not be pushed off the electrode rods with a force of 30 N. This situation did not change after the electrodes had been heated in a vacuum at 2500° C. in order to clean them.

What is claimed is:

1. A high pressure discharge lamp, comprising:

(a) a discharge vessel;

(b) a pair of current-supply conductors; and (c) a pair of discharge electrodes, each connected to a respective current-supply conductor and disposed with said discharge vessel so that an arc is maintained between said electrodes during lamp operation, each said electrode comprising an elongate electrode rod having a tip which defines a tip end of said discharge electrode, an electrode coil on said electrode rod having two layers, a first layer comprising a first length of wire having an outer surface and a first major width dimension, said first length of wire extending helically along the length dimension of said electrode up to a position proximate said discharge tip end, a second layer comprising a second length of wire having a second major width dimension, said second length of wire disposed around said first layer and extending helically along the length dimension of said electrode rod up to a position proximate said discharge tip end, said first layer further comprising a high-pitched turn having a pitch at least equal to the first major width dimension plus the second major width dimension, said second layer further comprising a crossing turn which crosses and engages said high-pitch turn, a portion of said crossing turn conforming substantially to said outer surface of said first wire length in the region of engagement so that said crossing turn is interlocked with said high pitched turn, said crossing turn engaging said electrode rod with a clamping fit in a region diametrically opposite the region where said crossing turn engages said high pitched turn so that said second layer is secured to said electrode rod and said electrode coil is secured to said electrode rod.

2. A lamp as claimed in claim 1, wherein said first layer has an end opposite said electrode rod tip end and said high-pitched turn is proximate said opposite end, and said outer layer comprises two turns which interlock with said high-pitched turn and engage said electrode rod with a clamping fit.

3. A lamp as claimed in claim 2, wherein each said length of wire has a pair of ends and said ends are rupture surfaces formed by tensile rupture.

4. A lamp as claimed in claim 1, wherein said first layer has a pair of said high-pitch turns, and said second layer has a pair of said crossing turns, each said crossing turn interlocking with a respective high-pitched turn and engaging the electrode rod with a clamping fit.

5. A lamp as claimed in claim 4, wherein each said length of wire has a pair of ends and said ends are rupture surfaces formed by tensile rupture.

6. A high pressure discharge lamp, comprising:

(a) a discharge vessel;

(b) a pair of current-supply conductors; and (c) a pair of discharge electrodes, each connected to a respective current-supply conductor and disposed within said discharge vessel so that an arc is maintained between said electrodes during lamp operation, each said electrode comprising an elongate electrode rod having an end which defines a tip end of said discharge electrode, and a two layer electrode coil on said electrode rod, said coil comprising a length of wire having an outer surface and a major width dimension, said wire extending helically along the length dimension of said electrode rod up to a position proximate said discharge electrode tip end to form a first layer, said wire passing into a second layer extending along the length dimension of said electrode rod in a direction away from said discharge electrode tip end, said first layer comprising a high-pitched turn distant from said tip end with a pitch at least equal to two times said major width dimension, said second layer comprising a crossing turn which crosses and engages said high-pitched turn, said crossing turn conforming substantially to said outer surface of said wire in the region of engagement so that said crossing turn is interlocked with said high-pitched turn, said crossing turn engaging said electrode rod with a clamping fit in a region diametrically opposite the region where said crossing turn engages said high-pitched turn so that said second layer is secured to said electrode rod and said electrode coil is secured to said electrode rod.

7. A lamp as claimed in claim 6, wherein said length of wire has a pair of ends and said ends are rupture surfaces formed by tensile rupture.

8. A discharge lamp discharge electrode, comprising:

an elongate electrode rod having a tip which defines a tip end of said discharge electrode; and an electrode coil on said electrode rod having two layers, a first layer comprising a first length of wire having an outer surface and a first major width dimension, said first length of wire extending helically along the length dimension of said electrode rod up to a position proximate said discharge tip end, a second layer comprising a second length of wire having a second major width dimension, said second length of wire disposed around said first layer and extending helically along the length dimension of said electrode rod up to a position proximate said discharge tip end, said first layer comprising a high-pitched turn having a pitch at least equal to the first major width dimension plus the second major width dimension, said second layer comprising a crossing turn which crosses and engages said high-pitched turn, a portion of said crossing turn conforming substantially to said outer surface of said first wire length in the region of engagement so that said crossing turn is interlocked with said high pitched turn, said crossing turn engaging said electrode rod with a clamping fit in a region diametrically opposite the region where said crossing turn engages said high pitched turn so that said second layer is secured to said electrode rod and said electrode coil is secured to said electrode rod.

9. A discharge lamp discharge electrode, comprising an elongate electrode rod having an end which defines a tip end of said discharge electrode; and a two layer electrode coil on said electrode rod, said coil comprising a length of wire having an outer surface and a major width dimension, said wire extending helically along the length dimension of said electrode rod up to a position proximate said discharge electrode rod tip end to form a first layer, said wire passing into a second layer extending along the length dimension of said electrode rod in a direction away from said discharge tip end, said first layer having a high-pitched turn distant from said tip end with a pitch at least equal to two times said major width dimension, said second layer having a crossing turn which crosses and engages said high-pitched turn, said crossing turn conforming substantially to said outer surface of said length of wire in the region of engagement so that said crossing turn is interlocked with said high-pitched turn, said crossing turn engaging said electrode rod with a clamping fit in a region diametrically opposite the region where said crossing turn engages said high-pitched turn so that said second layer is secured to said electrode rod and said electrode coil is secured to said electrode rod.

10. A discharge lamp discharge electrode as claimed in claim 8, wherein each said length of wire has a pair of ends and said ends are rupture surfaces formed by tensile rupture.

11. A discharge lamp discharge electrode as claimed in claim 9, wherein said first layer has an end opposite said electrode rod tip end and said high-pitched turn is proximate said opposite end, and said outer layer comprises two turns which interlock with said high-pitched turn and engage said electrode rod with a clamping fit.

12. A discharge lamp discharge electrode as claimed in claim 8, wherein said first layer has a pair of said high-pitched turns, and said second layer has a pair of said crossing turns, each said crossing turn interlocking with a respective high-pitched turn and engaging the electrode rod with a clamping fit.

13. A discharge lamp discharge electrode as claimed in claim 9, wherein said length of wire has a pair of ends and said ends are rupture surfaces formed by tensile rupture.

14. A discharge lamp discharge electrode as claimed in claim 12, wherein each said length of wire has a pair of ends and said ends are rupture surfaces formed by tensile rupture.

* * * * *